US006461013B1

(12) United States Patent
Simon

(10) Patent No.: US 6,461,013 B1
(45) Date of Patent: Oct. 8, 2002

(54) DOOR KNOB LIGHTING ASSEMBLY

(76) Inventor: Richard L. Simon, 210 Herndon Ave. P.O. Box #313, York, SC (US) 29745

( * ) Notice: Subject to any disclaimer, the term of this patent is extended or adjusted under 35 U.S.C. 154(b) by 0 days.

(21) Appl. No.: 09/586,029

(22) Filed: Jun. 2, 2000

(51) Int. Cl.[7] ..... F21V 33/00
(52) U.S. Cl. ..... 362/100; 362/276
(58) Field of Search ..... 362/84, 100, 276, 362/802; 340/542, 545.1, 545.3, 555, 545.2

(56) References Cited

U.S. PATENT DOCUMENTS 2,136,677 A * 11/1938 Doeppel ..... 362/100
2,927,197 A * 3/1960 Phillips et al. ..... 362/100
3,560,950 A * 2/1971 Peters ..... 340/555
D248,184 S 6/1978 Roberts
4,475,067 A 10/1984 Rowe
4,779,171 A 10/1988 Ferguson
5,179,325 A 1/1993 Aragon, Jr.
5,398,175 A 3/1995 Pea
5,597,227 A 1/1997 Bergen et al.
5,996,383 A * 12/1999 Adelmeyer et al. ..... 362/100
6,278,366 B1 * 8/2001 Fletcher et al. ..... 362/100

* cited by examiner

*Primary Examiner*—Y. My Quach-Lee

(57) ABSTRACT

A door knob lighting assembly for providing light to iluminate a door knob at night. The door knob lighting assembly includes a light housing. A light is positioned in the light housing. The light housing is. A sensor is operationally coupled to the light for illuminating the light upon detection of a pre-determined condition by the sensor.

14 Claims, 7 Drawing Sheets

DOOR KNOB LIGHTING ASSEMBLY

BACKGROUND OF THE INVENTION

1. Field of the Invention

The present invention relates to illuminated door locks and more particularly pertains to a new door knob lighting assembly for providing light to iluminate a door knob at night.

2. Description of the Prior Art

The use of illuminated door locks is known in the prior art. More specifically, illuminated door locks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,179,325; 4,475,067; 5,597,227; 5,398,175; 4,779,171; and U.S. Patent No. Des 248,184.

While these devices fulfill their respective, particular objectives and requirements, the aforementioned patents do not disclose a new door knob lighting assembly. The inventive device includes a light housing designed for coupling to the door proximate the exterior door knob. A light is positioned in the light housing. The light housing is designed for directing light from the light towards the door knob of the door. A sensor is designed for coupling to the door. The sensor is operationally coupled to the light for illuminating the light upon detection of a pre-determined condition by the sensor.

In these respects, the door knob lighting assembly according to the present invention substantially departs from the conventional concepts and designs of the prior art, and in so doing provides an apparatus primarily developed for the purpose of providing light to iluminate a door knob at night.

SUMMARY OF THE INVENTION

In view of the foregoing disadvantages inherent in the known types of illuminated door locks now present in the prior art, the present invention provides a new door knob lighting assembly construction wherein the same can be utilized for providing light to iluminate a door knob at night.

The general purpose of the present invention, which will be described subsequently in greater detail, is to provide a new door knob lighting assembly apparatus and method which has many of the advantages of the illuminated door locks mentioned heretofore and many novel features that result in a new door knob lighting assembly which is not anticipated, rendered obvious, suggested, or even implied by any of the prior art illuminated door locks, either alone or in any combination thereof.

To attain this, the present invention generally comprises a light housing designed for coupling to the door proximate the exterior door knob. A light is positioned in the light housing. The light housing is designed for directing light from the light towards the door knob of the door. A sensor is designed for coupling to the door. The sensor is operationally coupled to the light for illuminating the light upon detection of a pre-determined condition by the sensor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new door knob lighting assembly apparatus and method which has many of the advantages of the illuminated door locks mentioned heretofore and many novel features that result in a new door knob lighting assembly which is not anticipated, rendered obvious, suggested, or even implied by any of the prior art illuminated door locks, either alone or in any combination thereof.

It is another object of the present invention to provide a new door knob lighting assembly which may be easily and efficiently manufactured and marketed.

It is a further object of the present invention to provide a new door knob lighting assembly which is of a durable and reliable construction.

An even further object of the present invention is to provide a new door knob lighting assembly which is susceptible of a low cost of manufacture with regard to both materials and labor, and which accordingly is then susceptible of low prices of sale to the consuming public, thereby making such door knob lighting assembly economically available to the buying public.

Still yet another object of the present invention is to provide a new door knob lighting assembly which provides in the apparatuses and methods of the prior art some of the advantages thereof, while simultaneously overcoming some of the disadvantages normally associated therewith.

Still another object of the present invention is to provide a new door knob lighting assembly for providing light to iluminate a door knob at night.

Yet another object of the present invention is to provide a new door knob lighting assembly which includes a light housing designed for coupling to the door proximate the exterior door knob. A light is positioned in the light housing. The light housing is designed for directing light from the light towards the door knob of the door. A sensor is designed for coupling to the door. The sensor is operationally coupled to the light for illuminating the light upon detection of a pre-determined condition by the sensor.

Still yet another object of the present invention is to provide a new door knob lighting assembly that automatically detects the presence of a person proximate the door knob and illuminates the door knob to make it easier for a person to insert a key in the keyhole.

Even still another object of the present invention is to provide a new door knob lighting assembly that provides a sense of security as the sudden lighting of the door knob may deter an intruder from entering the premises or alert a person that someone has been near the door upon a persons approach to the door and seeing the door knob illuminated.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
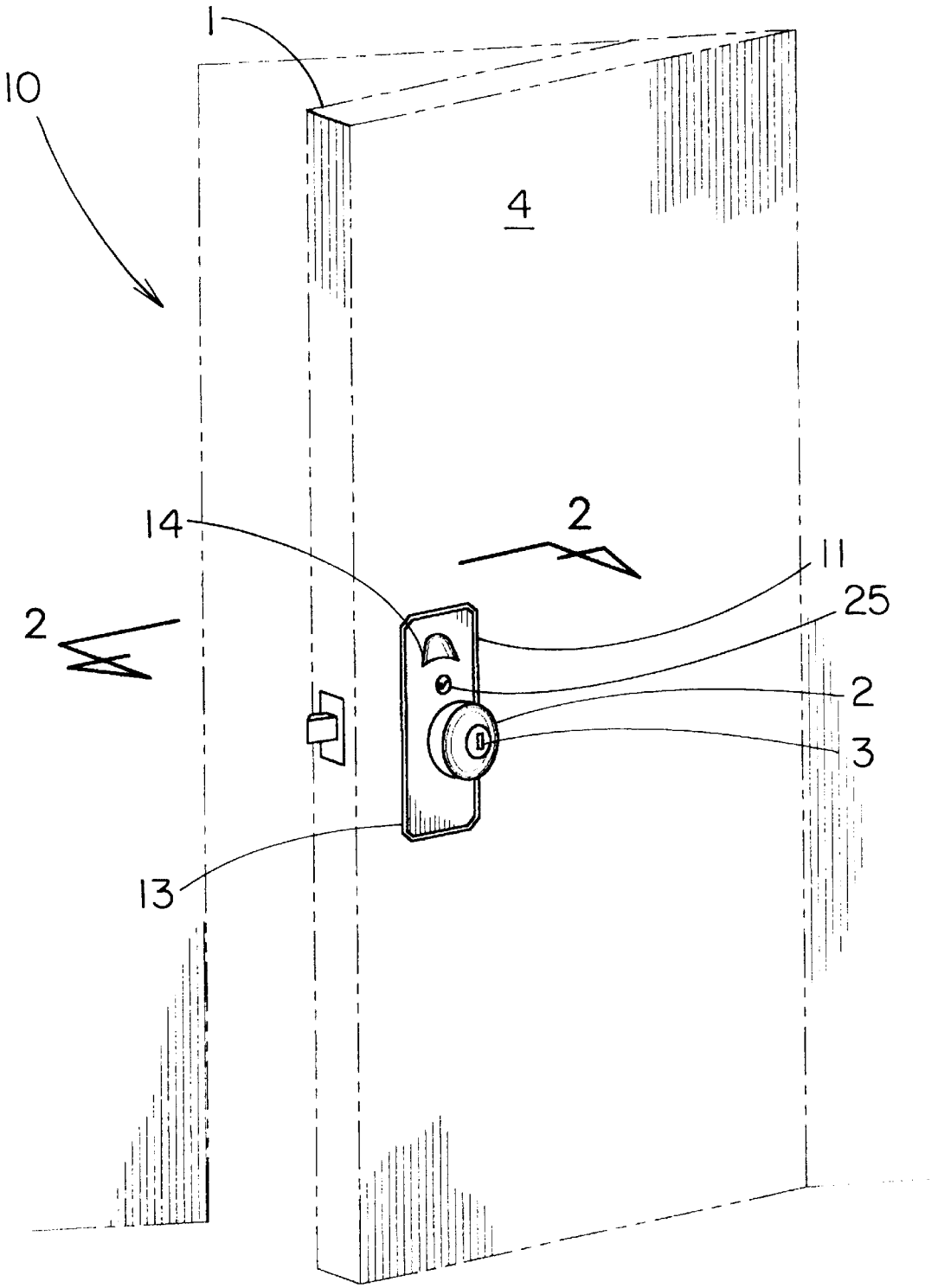
FIG. 1 is a perspective view of a new door knob lighting assembly according to the present invention.
Figure 2:
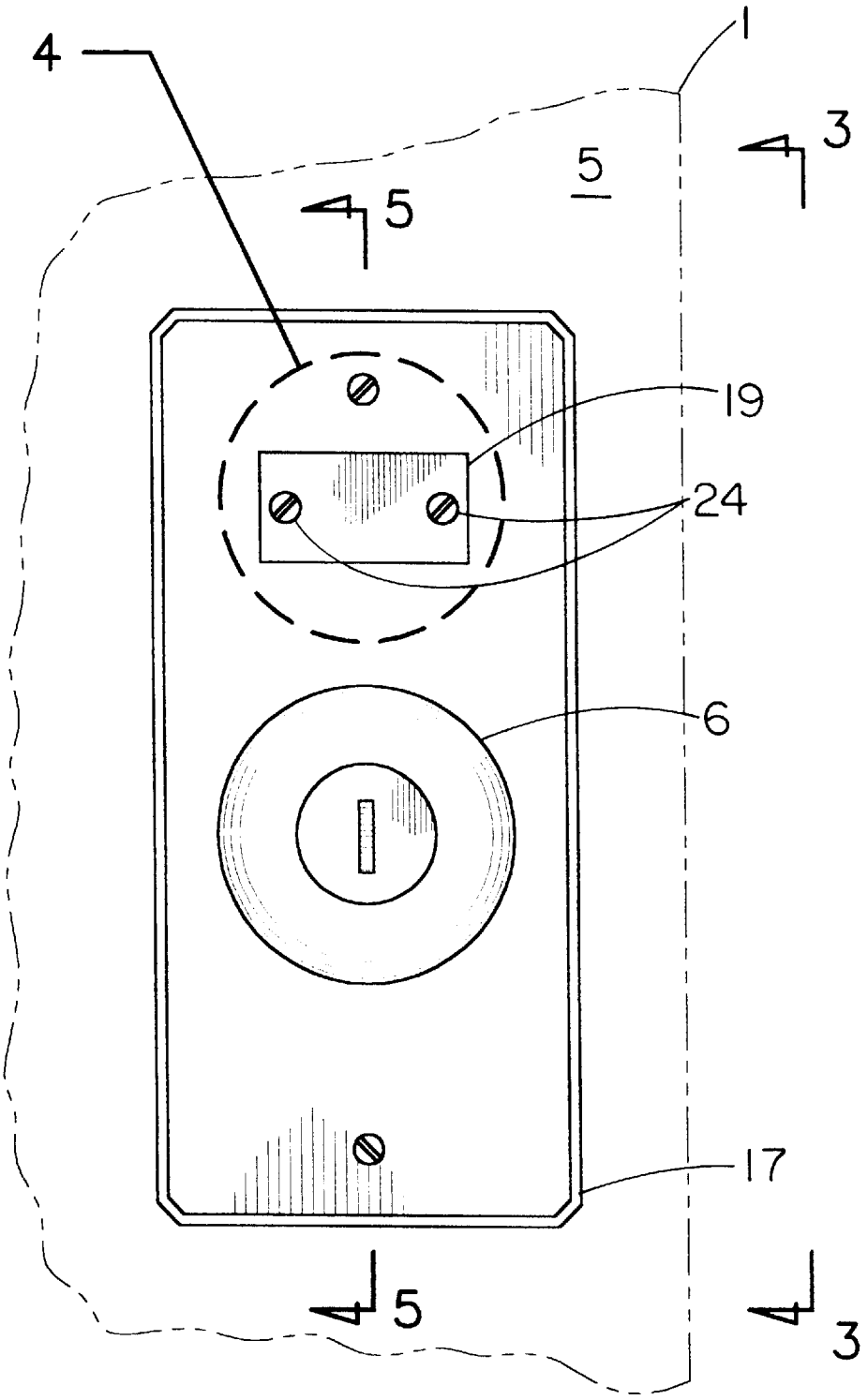
FIG. 2 is an elevational view of the inner face plate of the present invention taken along line 2—2 of FIG. 1.
Figure 3:
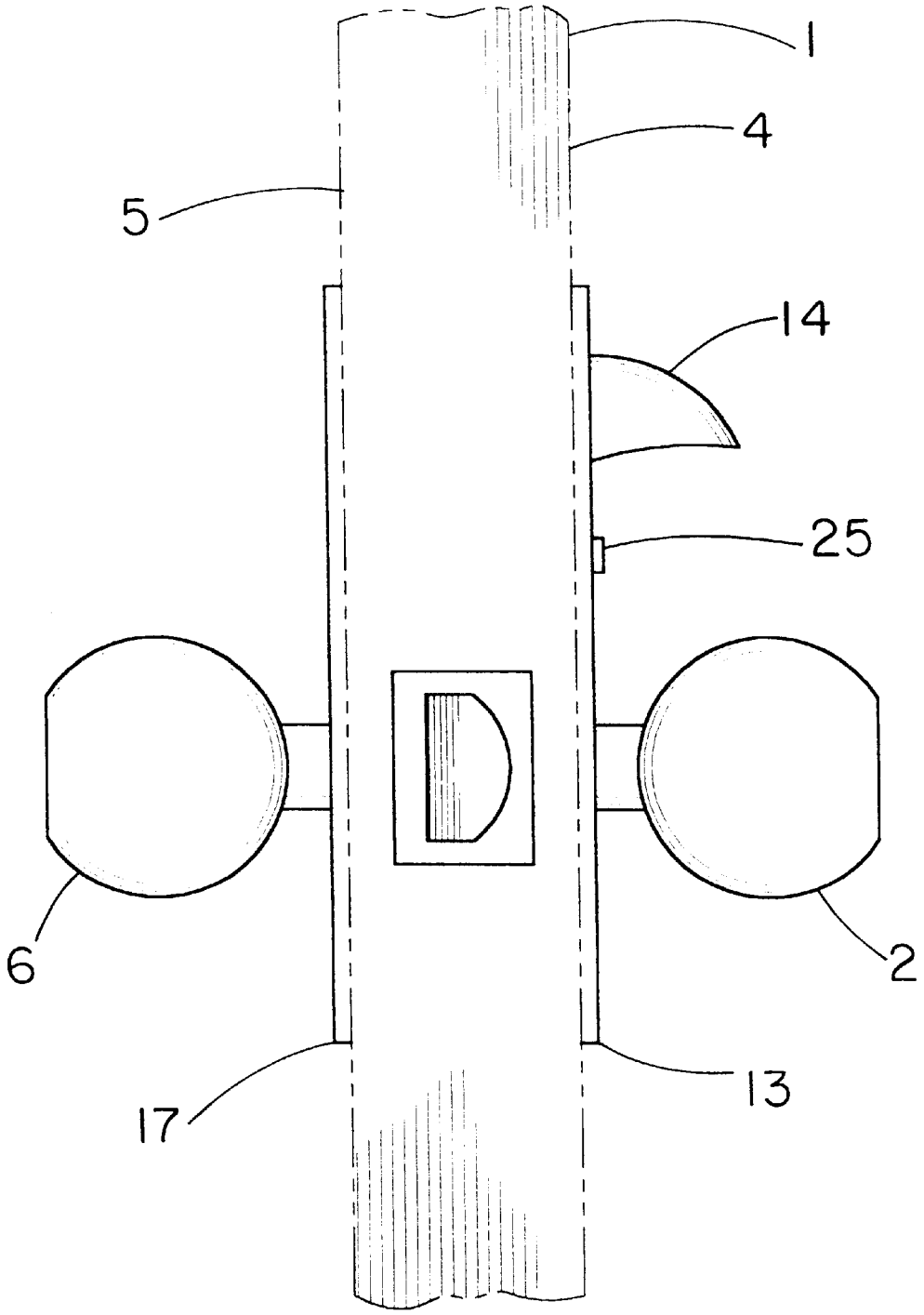
FIG. 3 is a side elevational view of the present invention taken along line 3—3 of FIG. 2.

With reference now to the drawings, and in particular to FIGS. 1 through 7 thereof, a new door knob lighting assembly embodying the principles and concepts of the present invention and generally designated by the reference numeral 10 will be described.

As best illustrated in FIGS. 1 through 7, the door knob lighting assembly 10 generally comprises a light housing 11 designed for coupling to a door 1 proximate an exterior door knob 2. A light 12 is positioned in the light housing. The light housing is designed for directing light from the light towards the door knob of the door. In an embodiment the light is in a circular shape and is proximate a keyhole 3 of the door knob for illuminating the keyhole directly or for casting light within a semi-transparent door knob such that the entire door knob is illuminated.

The housing further comprises an outer face plate 13 designed for coupling to an outer face 4 of the door. The outer face plate includes a shroud member 14 extending outwardly from the outer face plate. The shroud member forms an opening between a lower edge of the shroud member and the outer face plate. The light is coupled to the outer face plate such that the light is positioned under the shroud member between the opening and the outer face plate. The shroud member is positioned such that the opening faces the exterior door knob whereby light from the light is directed towards the exterior door knob when the light is illuminated. The outer face plate includes an outer plate knob aperture 15 for positioning the outer face plate around the exterior door knob when the outer face plate is coupled to the door. The outer face plate comprises a light aperture 16.

An inner face plate 17 is designed for coupling to an inner face 5 of the door. The inner face plate includes a battery compartment 18 and a battery compartment door 19. The inner face plate includes an inner plate knob aperture 20 for positioning the inner face plate around an interiorly positioned door knob 6 when the inner face plate is coupled to the door.

Figure 4:
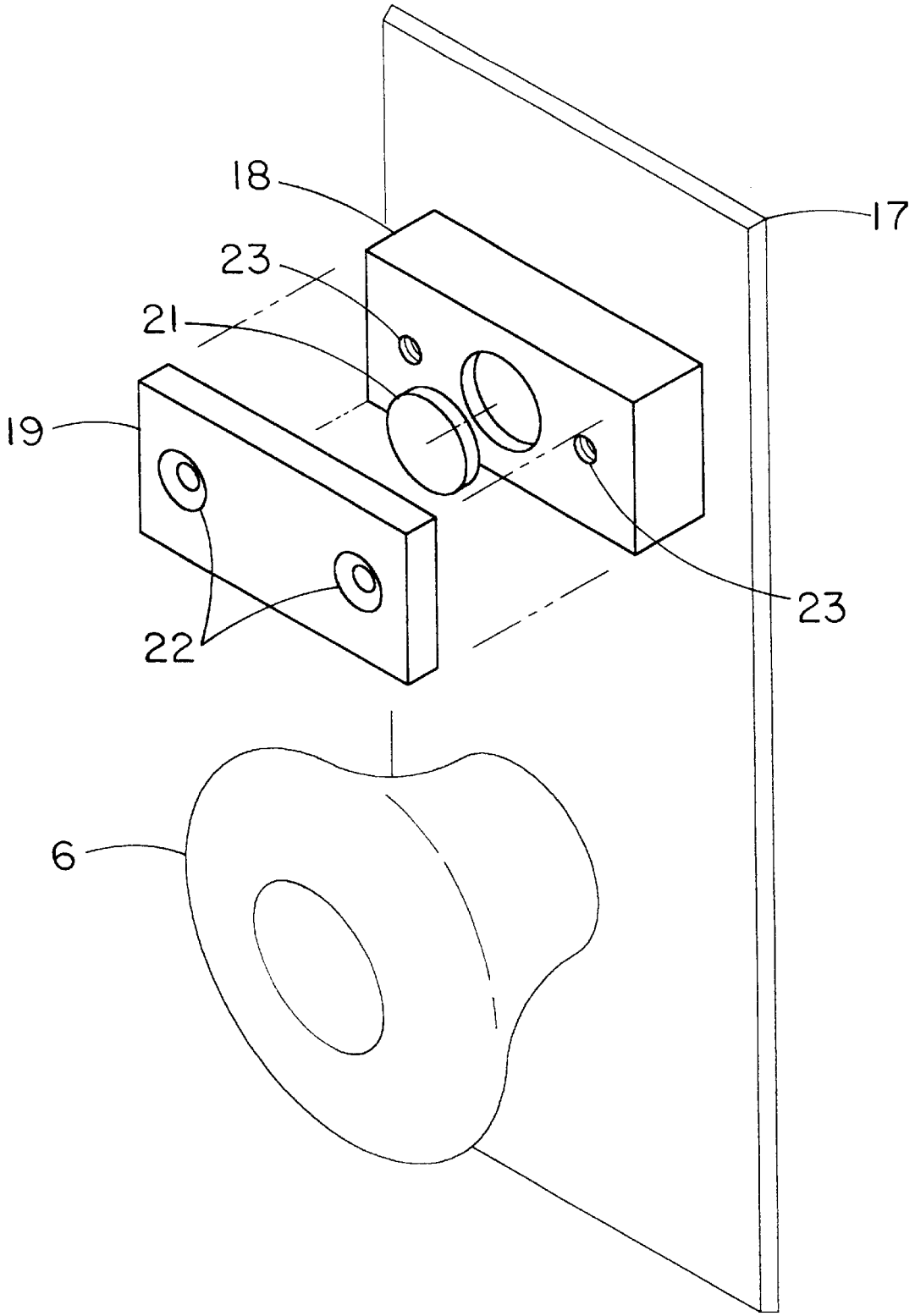
FIG. 4 is an enlarge exploded view of the area labeled 4 in FIG. 2 of the present invention.

As shown in FIG. 4, battery 21 is positionable in the battery compartment. The battery is operationally coupled to the light for providing power to the light for illuminating the light. The battery door includes at least on aperture 22. The inner face plate includes an associated threaded connection aperture 23 for each aperture of the battery door. The aperture of the battery door is alignable with the associated threaded connection aperture of the inner face plate when the battery door is positioned to cover the battery compartment. A connection member 24 for each aperture of the battery door is for inserting through the aperture of the battery door and threadably engaging the threaded connection aperture whereby the battery door is secured to the inner face plate.

Figure 5:
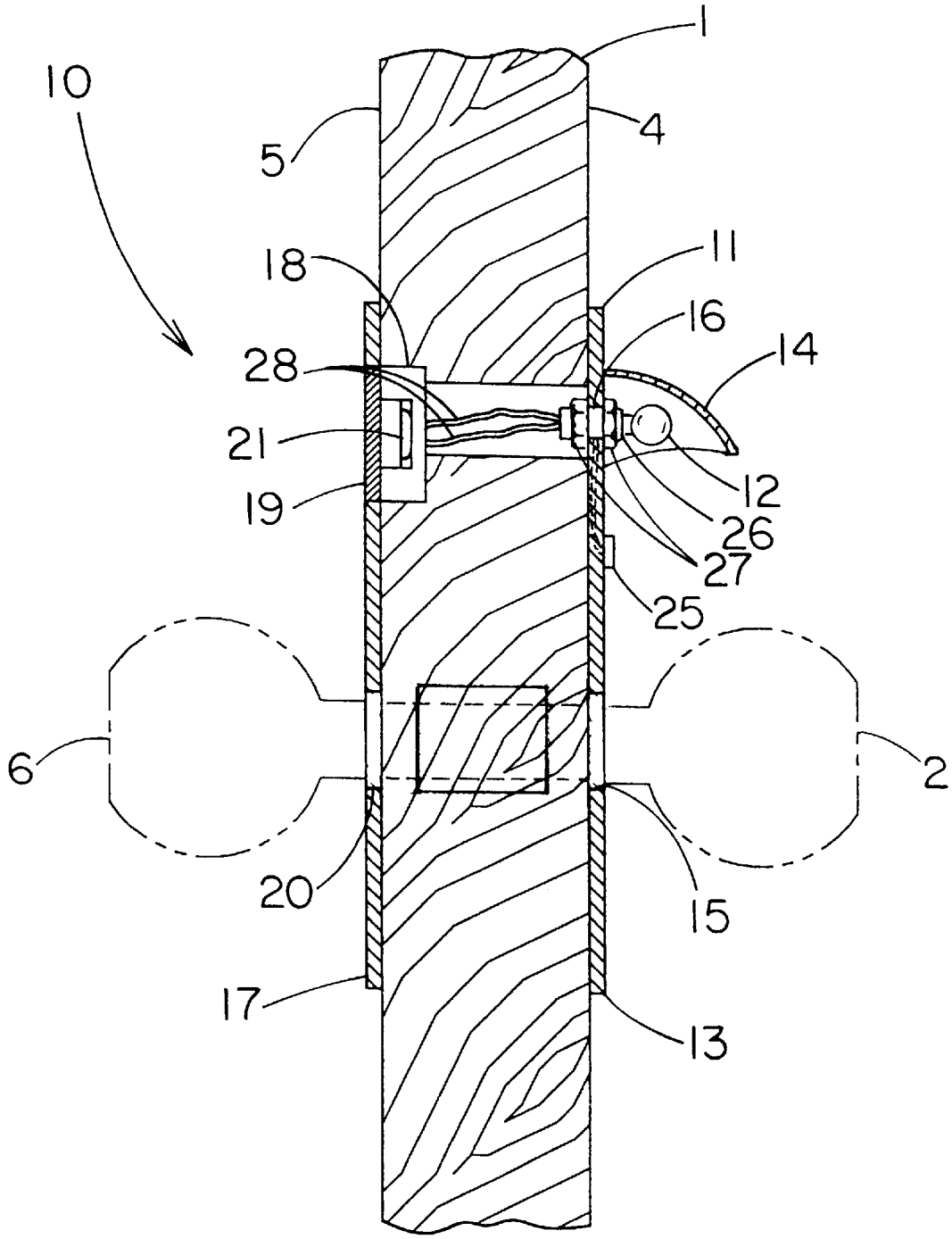
FIG. 5 is a cross-sectional view of the present invention taken along line 5—5 of FIG. 2.
Figure 6:
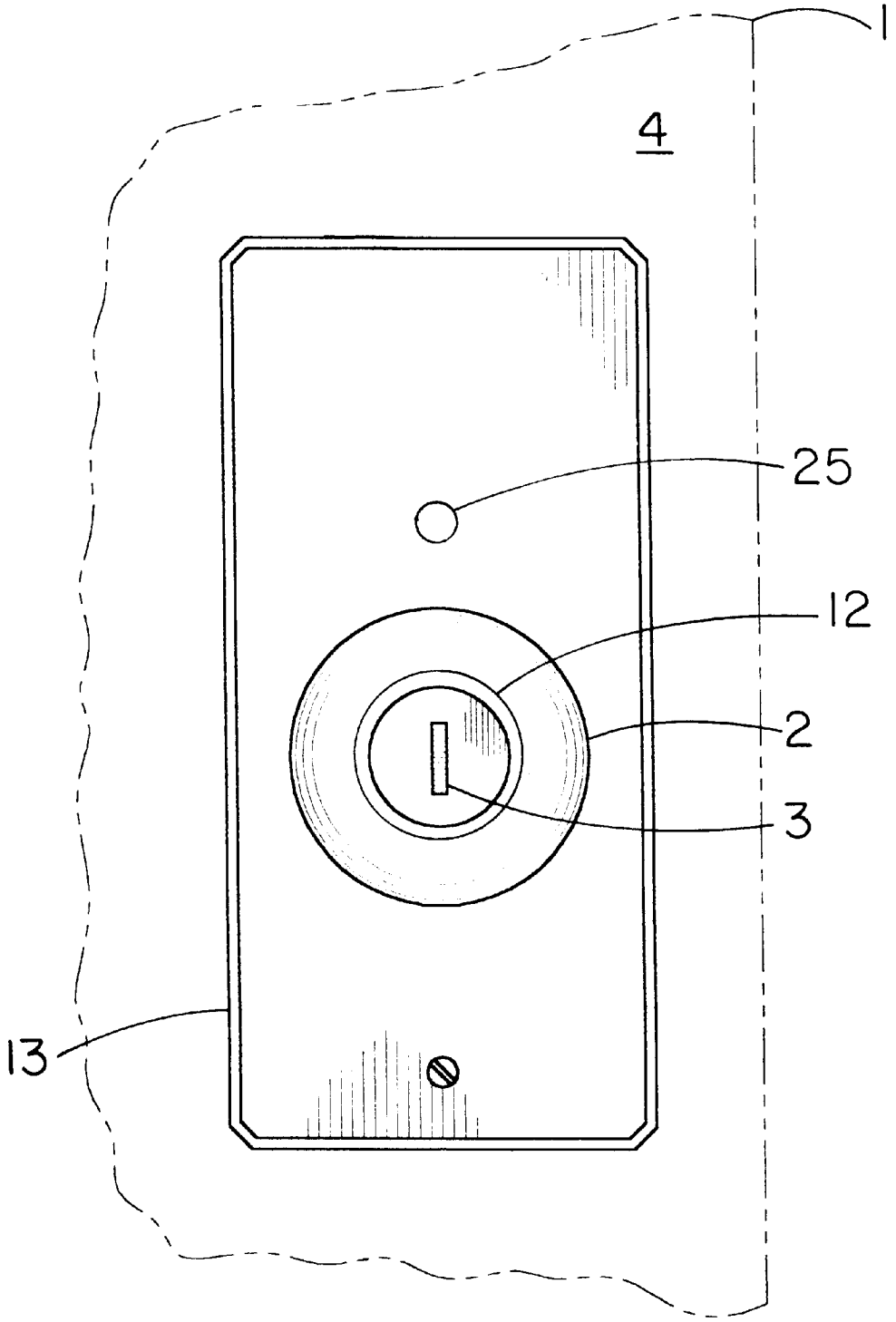
FIG. 6 is an elevational view of the outer face plate of an embodiment the present invention.
Figure 7:
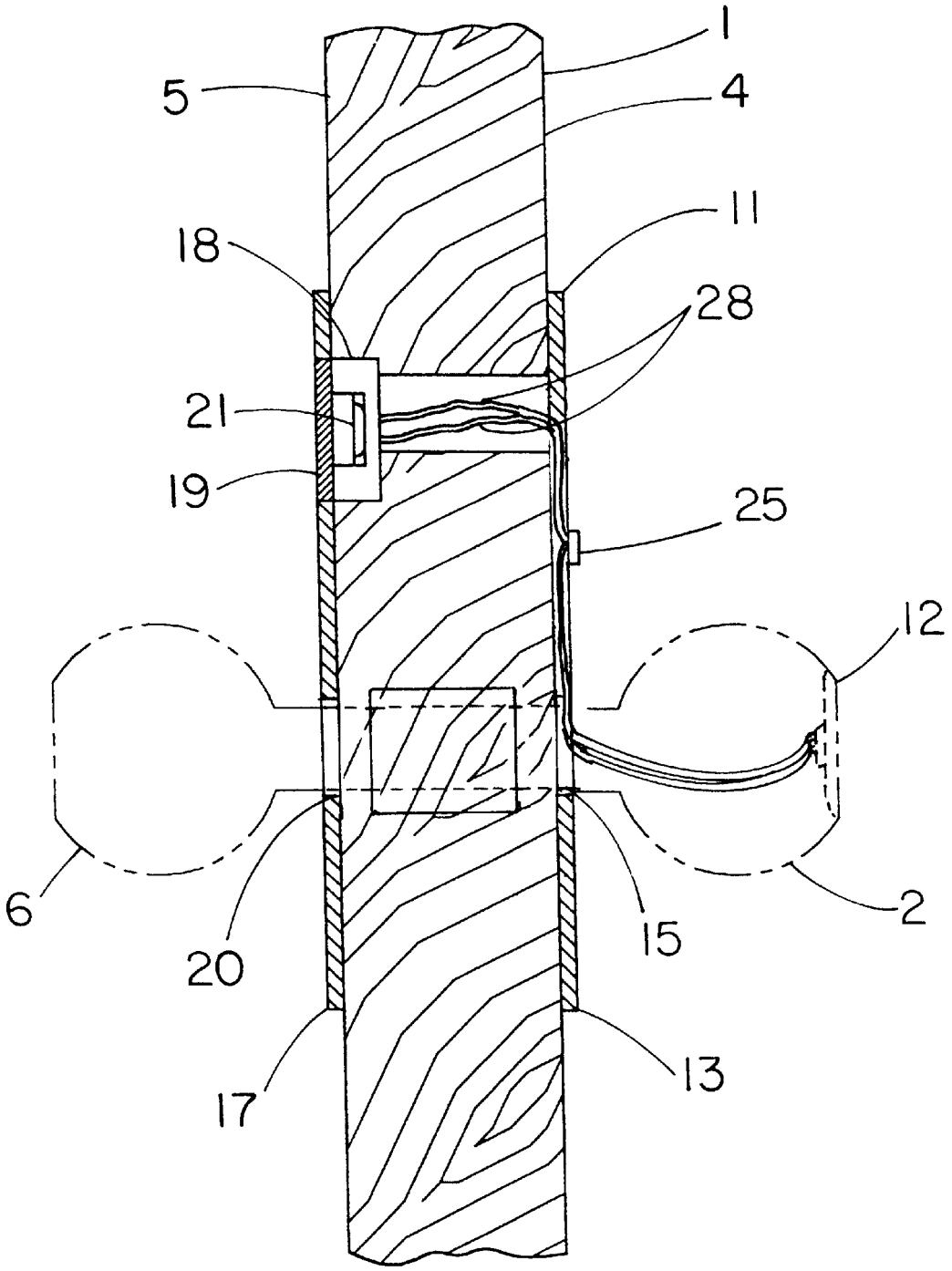
FIG. 7 is a cross sectional view of an embodiment the present invention.

As shown in FIG. 5, A sensor 25 is designed for coupling to the door. The sensor is operationally coupled to the light for illuminating the light upon detection of a pre-determined condition by the sensor. The sensor is coupled to the outer face plate. The sensor is positioned between the opening and the outer plate knob aperture. The sensor illuminates the light for a pre-determined period of time upon detection of the pre-determined condition. In an embodiment the sensor detects motion whereby the sensor illuminates the light upon detection of motion proximate the sensor. In another embodiment the sensor detects heat whereby the sensor illuminates the light upon detection of a heat level proximate the sensor over a pre-determined threshold heat value. In another embodiment the sensor detects sound whereby the sensor illuminates the light upon detection of a sound level proximate the sensor over a pre-determined threshold sound value.

A light fixture member 26 is insertable through the light aperture. A pair of fixture connection members 27 are engageable to the light fixture member. Each of the pair of fixture connection members is positionable on a respective side of the outer face plate whereby the light fixture member is held in a static position relative to the outer face plate. The battery compartment is alignable with a rear of the light fixture member when the outer face plate and the inner face plate are coupled to the door.

A plurality of electrical wires 28 are couplable between a pair of contacts positioned in the battery compartment, the light fixture member and the sensor. The battery is generally disk-shaped. The battery compartment is sized such that tightening of the battery compartment door to against the inner face plate urges the battery into contact with the contacts for permitting illumination of the light by the sensor.

In use, a user installs the door knob light assembly within a door. The user then places the battery within the battery compartment. When a person approaches the door knob, with the sensor in proximate location to that door knob, the sensor detects the persons presence and activates the light for about a 1 minute duration before deactivating the light. The light illuminates the door knob and the key hole such that the user may readily find the door knob and keyhole in the dark.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A door knob lighting assembly for coupling to a door proximate an exterior door knob of the door, said door knob lighting assembly comprising:

a light housing adapted for coupling to the door proximate the exterior door knob;

a light positioned in said light housing, said light housing being structured to permit light from said light to illuminate the door knob of the door;

a sensor adapted for coupling to the door, said sensor being operationally coupled to said light for illuminating said light upon detection of a pre-determined condition by said sensor;

an inner face plate adapted for coupling to an inner face of the door, said inner face plate including a battery compartment and a battery compartment door;

a battery positionable in said battery compartment, said battery being operationally coupled to said light for providing power to said light for illuminating said light;

wherein said housing further comprises an outer face plate adapted for coupling to an outer face of the door;

said outer face plate including a shroud member extending outwardly from said outer face plate, said shroud member forming an opening between a lower edge of said shroud member and said outer face plate;

said light being coupled to said outer face plate such that said light is positioned under said shroud member between said opening and said outer face plate, said shroud member being positioned such that said opening faces the exterior door knob whereby light from said light is directed towards the exterior door knob when the light is illuminated.

2. The door knob lighting assembly of claim 1, further comprising:

said inner face plate including an inner plate knob aperture for positioning said inner face plate around an interiorly positioned door knob when the inner face plate is coupled to the door.

3. The door knob lighting assembly of claim 1, wherein said sensor detects motion whereby said sensor illuminates said light upon detection of motion proximate said sensor.

4. A door knob lighting assembly for coupling to a door proximate an exterior door knob of the door, said door knob lighting assembly comprising:

a light housing adapted for coupling to the door proximate the exterior door knob;

a light positioned in said light housing, said light housing being structured to permit light from said light to illuminate the door knob of the door;

a sensor adapted for coupling to the door, said sensor being operationally coupled to said light for illuminating said light upon detection of a pre-determined condition by said sensor;

an inner face plate adapted for coupling to an inner face of the door, said inner face plate including a battery compartment and a battery compartment door;

a battery positionable in said battery compartment, said battery being operationally coupled to said light for providing power to said light for illuminating said light;

said battery door including at least one aperture;

said inner face plate including an associated threaded connection aperture for each aperture of said battery door, said aperture of said battery door being alignable with said associated threaded connection aperture of said inner face plate when said battery door is positioned to cover said battery compartment; and a connection member for each aperture of said battery door, said connection member being for inserting through said aperture of said battery door and threadably engaging said threaded connection aperture whereby said battery door is secured to said inner face plate.

5. The door knob lighting assembly of claim 4, further comprising:

wherein said housing further comprises an outer face plate adapted for coupling to an outer face of the door;

said outer face plate including a shroud member extending outwardly from said outer face plate, said shroud member forming an opening between a lower edge of said shroud member and said outer face plate;

said light being coupled to said outer face plate such that said light is positioned under said shroud member between said opening and said outer face plate, said shroud member being positioned such that said opening faces the exterior door knob whereby light from said light is directed towards the exterior door knob when the light is illuminated;

said outer face plate including an outer plate knob aperture for positioning said outer face plate around the exterior door knob when the outer face plate is coupled to the door;

said inner face plate including an inner plate knob aperture for positioning said inner face plate around an interiorly positioned door knob when the inner face plate is coupled to the door;

said sensor being coupled to said outer face plate, said sensor being positioned between said opening and said outer plate knob aperture;

said outer face plate having a light aperture;

a light fixture member insertable through said light aperture;

a pair of fixture connection members engaged to said light fixture member, each of said pair of fixture connection members being positionable on a respective side of said outer face plate whereby said light fixture member is held in a static position relative to said outer face plate;

said battery compartment being alignable with a rear of said light fixture member when said outer face plate and said inner face plate are coupled to the door;

a plurality of electrical wires couplable between a pair of contacts positioned in said battery compartment and said light fixture member;

wherein said battery is generally disk-shaped, said battery compartment being sized such that tightening of said battery compartment door to against said inner face plate urges said battery into contact with said contacts for permitting illumination of said light by said sensor; and wherein said sensor illuminates said light for a pre-determined period of times upon detection of said pre-determined condition.

6. The door knob lighting assembly of claim 5, wherein said sensor detects motion whereby said sensor illuminates said light upon detection of motion proximate said sensor.

7. The door knob lighting assembly of claim 5, wherein said sensor detects heat whereby said sensor illuminates said light upon detection of a heat level proximate said sensor over a predetermined threshold heat value.

8. The door knob lighting assembly of claim 5, wherein said sensor detects sound whereby said sensor illuminates said light upon detection of a sound level proximate said sensor over a predetermined threshold sound value.

9. A door knob lighting assembly for coupling to a door proximate an exterior door knob of the door, said door knob lighting assembly comprising:

a light housing adapted for coupling to the door proximate the exterior door knob;

a light positioned in said light housing, said light housing being structured to permit light from said light to illuminate the door knob of the door;

a sensor adapted for coupling to the door, said sensor being operationally coupled to said light for illuminating said light upon detection of a pre-determined condition by said sensor;

wherein said housing further comprises an outer face plate adapted for coupling to an outer face of the door;

said outer face plate including a shroud member extending outwardly from said outer face plate, said shroud member forming an opening between a lower edge of said shroud member and said outer face plate;

said light being coupled to said outer face plate such that said light is positioned under said shroud member between said opening and said outer face plate, said shroud member being positioned such that said opening faces the exterior door knob whereby light from said light is directed towards the exterior door knob when the light is illuminated;

said outer face plate including an outer plate knob aperture for positioning said outer face plate around the exterior door knob when the outer face plate is coupled to the door.

10. The door knob lighting assembly of claim 9, further comprising:

said sensor being coupled to said outer face plate, said sensor being positioned between said opening and said outer plate knob aperture.

11. A door knob lighting assembly for coupling to a door proximate an exterior door knob of the door, said door knob lighting assembly comprising:

a light housing adapted for coupling to the door proximate the exterior door knob;

a light positioned in said light housing, said light housing being structured to permit light from said light to illuminate the door knob of the door;

a sensor adapted for coupling to the door, said sensor being operationally coupled to said light for illuminating said light upon detection of a pre-determined condition by said sensor;

wherein said housing further comprises an outer face plate adapted for coupling to an outer face of the door;

said outer face plate including a shroud member extending outwardly from said outer face plate, said shroud member forming an opening between a lower edge of said shroud member and said outer face plate;

said light being coupled to said outer face plate such that said light is positioned under said shroud member between said opening and said outer face plate, said shroud member being positioned such that said opening faces the exterior door knob whereby light from said light is directed towards the exterior door knob when the light is illuminated;

said outer face plate having a light aperture;

a light fixture member insertable through said light aperture;

a pair of fixture connection members engaged to said light fixture member, each of said pair of fixture connection members being positionable on a respective side of said outer face plate whereby said light fixture member is held in a static position relative to said outer face plate.

12. A door knob lighting assembly for coupling to a door, the door knob lighting assembly comprising:

the door having an outer door knob and an inner door knob;

a light positioned in said outer door knob such that is for illuminating said outer door knob;

a sensor adapted for coupling to the door, said sensor being operationally coupled to said light for illuminating said light upon detection of a pre-determined condition by said sensor;

an inner face plate adapted for coupling to an inner face of the door, said inner face plate including a battery compartment and a battery compartment door;

a battery positionable in said battery compartment, said battery being operationally coupled to said light for providing power to said light for illuminating said light;

said battery door including at least one aperture;

said inner face plate including an associated threaded connection aperture for each aperture of said battery door, said aperture of said battery door being alignable with said associated threaded connection aperture of said inner face plate when said battery door is positioned to cover said battery compartment; and a connection member for each aperture of said battery door, said connection member being for inserting through said aperture of said battery door and threadably engaging said threaded connection aperture whereby said battery door is secured to said inner face plate.

13. The door knob lighting assembly of claim 12 further comprising:

an outer face plate adapted for coupling to an outer face of the door;

said light being coupled to said outer door knob such that said light is positioned around a keyhole of said outer door knob, said light being positioned such that light from said light is directed towards the keyhole when the light is illuminated.

14. The door knob lighting assembly of claim 12, wherein:

said sensor is coupled to an outer face plate, said sensor being positioned proximate said outer door knob.

* * * * *